United States Patent [19]

Jacobs, Jr.

[11] 4,161,714

[45] Jul. 17, 1979

[54] ELECTRIC FUSE

[75] Inventor: Philip C. Jacobs, Jr., Newtonville, Mass.

[73] Assignee: Gould, Inc., Rolling Meadows, Ill.

[21] Appl. No.: 844,720

[22] Filed: Oct. 25, 1977

[51] Int. Cl.[2] ..... H01H 85/16

[52] U.S. Cl. ..... 337/253; 337/251; 337/268

[58] Field of Search ..... 337/253, 252, 251, 254, 337/268, 186

[56] References Cited

U.S. PATENT DOCUMENTS

| | | | |
|---|---|---|---|
| 1,638,534 | 8/1927 | Kelsay | 337/253 |
| 2,863,967 | 12/1958 | Swain | 337/254 |
| 3,979,709 | 9/1976 | Healey, Jr. | 337/186 |

*Primary Examiner*—Harold Broome

*Attorney, Agent, or Firm*—Erwin Salzer

[57] ABSTRACT

A cartridge type fuse having a casing. A pair of terminal plugs is press-fitted into the ends of said casing and conductively interconnected by a fusible element. Each of said pair of terminal plugs has a knurled lateral wall. A pair of annular fasteners is mounted on said casing each adjacent one of the ends thereof. Said fasteners press the wall of said casing radially inwardly into firm engagement with said knurled lateral walls of said pair of terminal plugs. The casing preferably includes an outermost ply of woven glass cloth, an innermost ply of woven glass cloth, and at least one intermediate ply of relatively loose non-woven fibers sandwiched between said outermost ply and said innermost ply, and the constituent plies of said casing are preferably integrated by polyester resin.

6 Claims, 5 Drawing Figures

FIG. 1
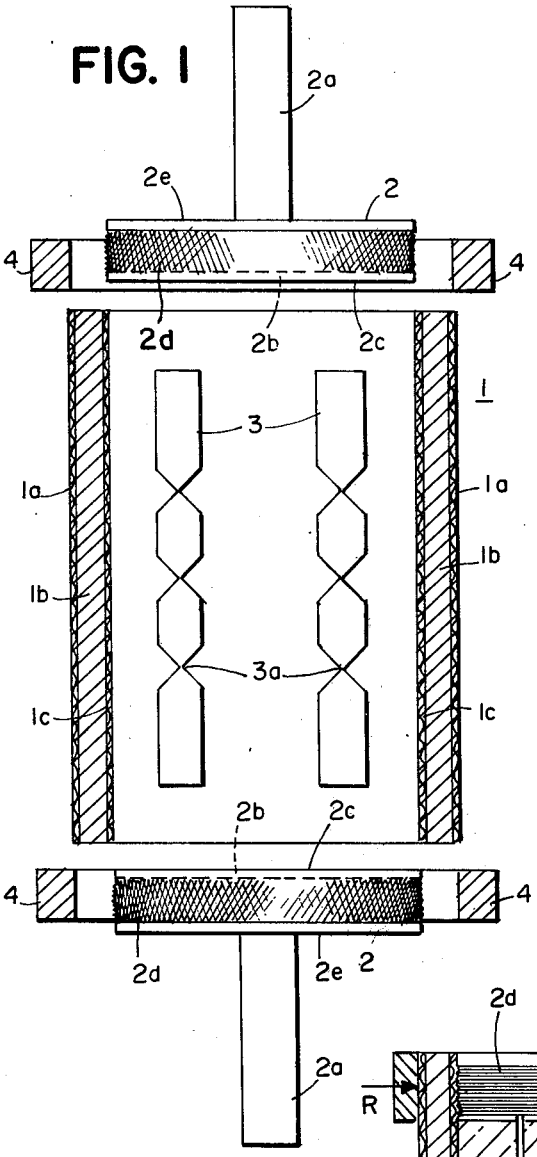
FIG. 3
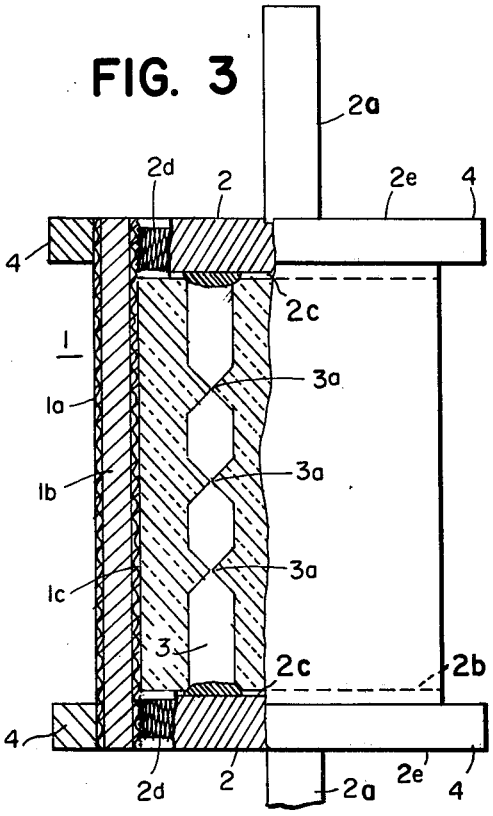
FIG. 2
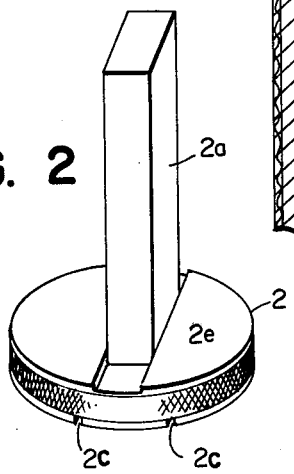
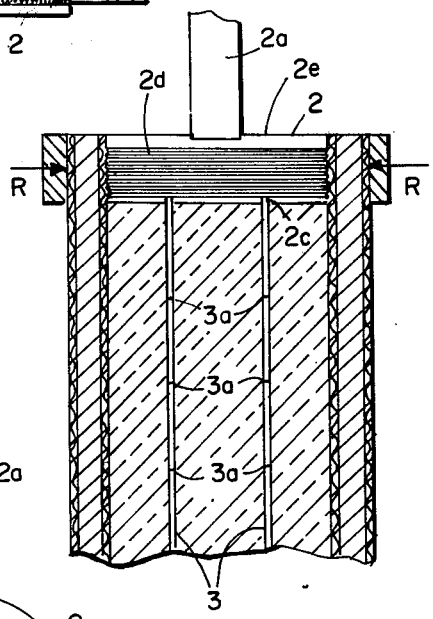
FIG. 4
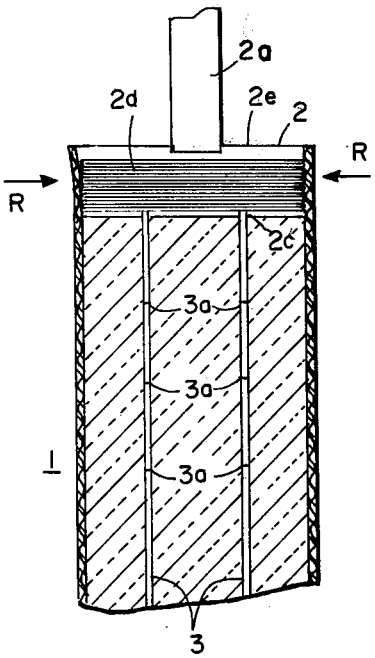
FIG. 5

ELECTRIC FUSE

BACKGROUND OF THE INVENTION

U.S. Pat. No. 3,979,709 to Daniel P. Healey, Sept. 7, 1976 for ELECTRIC FUSE HAVING A MULTIPLY CASING OF SYNTHETIC-RESIN-GLASS-CLOTH, discloses a new electric fuse, the particular novelty of the fuse consisting in a novel casing material produced by the pultrusion process. The novel casing material has mechanical properties which facilitate performance of certain functions thereof, such as, for instance, closing of a casing, or fuse tube, by a pair of terminal caps or ferrules. Difficulties arose when it came to close the casing, or fuse tube, by terminal plugs which are inserted into the ends of a casing, or fuse tube. In that instance the flexibility of the particular pultruded material described in the above Healey patent allowed the escape of hot products of arcing on blowing of the fuse, which tends to cause electric breakdowns in the surrounding of the fuse.

Fuses as described in the above Healey U.S. Pat. No. 3,979,709 have a great bursting strength but are relatively soft and flexible which results (a) from the presence of one or more intermediate plies of relatively loose non-woven fibers, and (b) from the relatively softness of the synthetic bonding resin, e.g. polyester resins.

It is the prime object of the present invention to provide means allowing to close reliably and inexpensively relatively soft casings, or fuse tubes, e.g. casings as disclosed in the above Healey U.S. Pat. No. 3,979,709, by terminal plugs.

Another object of this invention is to provide means which allow to close casings, or fuse tubes, by terminal plugs but without the pins which have heretofore been used to connect the fuse casings, or fuse tubes, to the terminal plugs. It is well known that this way of affixing terminal plugs to fuse casings is expensive since it involves several sequential operations and a relatively large number of pins and means for insulating and or enlarging the ends of the pins.

According to the aforementioned Healey U.S. Pat. No. 3,979,709 an electric fuse embodying the Healey invention comprises a fusible element, an arc-quenching means surrounding said fusible element, a pair of terminal elements arranged on the end of, and supported by, a casing and conductively interconnected by said fusible element. Said casing includes a first ply formed of non-woven glass fiber mat material having non-uniformly oriented fibers and a second and a third ply arranged on opposite sides of said first ply and sandwiching said first ply. Said second ply and said third ply each are of woven glass fiber fabric and each said second ply and said third ply form an overlap extending in a direction longitudinally of said casing. Said overlap of said second ply and said overlap of said third ply are angularly displaced relative to each other. The aforementioned casing includes a thermosetting resin integrating said first ply, said second ply and said third ply into a laminate. The glass fiber density of said laminate is locally increased in the region of said overlap of said second ply and of said third ply to such an extent that the wall thickness of said casing is virtually uniform along the entire periphery thereof.

If such a casing is merely closed by terminal plugs hot products of arcing are allowed to escape through the narrow gap formed between the inner casing wall and the outer terminal plug wall. A casing of a relatively hard synthetic resin such as melamine resin and convolutely wound fiber glass cloth if of normal thickness does not allow an escape of hot products of arcing. The difference in the behavior of both products may be attributed to the fact that glass cloth melamine tubing is a harder, highly homogenous material, while the above pultruded material is non-homogenous and contains zones where the fiber reinforcement is less than in other zones, and the elasticity of the material is consequently larger in one zone than in another. This allows an expansion of the small gap formed between the terminal plug and the casing, and the consequent escape of products of arcing. To be more specific, it appears that the tubing of Healey is slightly more elastic at the points thereof where the ratio of glass fiber to resin is relatively small.

SUMMARY OF THE INVENTION

A fuse embodying the present invention includes a fusible element immersed in a pulverulent arc-quenching filler. A tubular fuse casing of a relatively soft and relatively elastic reinforced synthetic resin—i.e. a synthetic resin which is inherently elastic or elastic on account of its small wall thickness—houses said fusible element and said filler. A pair of circular terminal plugs having end surfaces of equal area are press-fitted into the ends of said casing. Said pair of terminal plugs are conductively interconnected by said fusible element and the lateral walls of said pair of terminal plugs are knurled. A pair of metal rings or annual fasteners exposing said end surfaces of said pair of terminal plugs is mounted on the outer surface of said casing adjacent the ends thereof and presses the wall of said casing radially inwardly into firm engagement with the knurled portion of said pair of terminal plugs.

BRIEF DESCRIPTION OF THE DRAWINGS

FIG. 1 is an exploded view of the parts which go into a fuse embodying the present invention;

FIG. 2 is an isometric view of a plug terminal embodying the present invention;

FIG. 3 is partly a longitudinal section and partly a side elevation of a fuse embodying the present invention; and FIGS. 4 and 5 are elevations of portions of fuses illustrating the invention.

DESCRIPTION OF THE PREFERRED EMBODIMENTS

Reference numeral 1 has been applied to generally designate a casing, or fuse tube, whose wall is relatively flexible, e.g. a casing, or fuse tube, according to U.S. Pat. No. 3,979,709. It includes an outermost layer 1*a* of woven glass cloth the ends of which overlap in a direction longitudinally of casing 1. It further includes an innermost layer 1*c* of woven glass cloth the ends of which overlap in a direction longitudinally of casing 1. The two overlaps are angularly displaced, e.g. 180 deg. The mat layer or mat ply 1*b* is arranged between plies 1*a* and 1*c*. Instead of providing but one mat layer 1*b* several of such layers may be provided.

The ends of casing 1 are closed by a pair of terminal plugs 2. Each of terminal plugs 2 is provided with a blade contact 2*a*. The preponderant portion of the lateral walls of terminal plugs 2 is knurled. Preferably plugs 2 are cross-knurled, i.e. they have each two systems of helical knurles, one rising from left to right and one rising from right to left. The axially innermost end surfaces 2*b* of plug terminals 2 are not knurled. End surfaces 2*b* are provided with grooves 2*c* which serve for insertion of the ends of fusible elements 3. Each of elements 3 is provided with serially related points 3*a* of minimal cross-section. It is at these points where arc initiation occurs on occurrence of major fault currents.

A structural unit is formed of parts 2 and 3 which is subsequently inserted into casing 1. In that assembly state the parts 2 are spaced or separated by one or more metal rods (not shown). Thereafter fuse tube or casing 1 is mounted upon knurled plug terminals as shown in FIGS. 3 to 5, FIG. 3 showing cross-knurls and FIGS. 4 and 5 circular knurls. FIG. 5 also shows diagrammatically in an exagerated way the outward bending of fuse tube, or casing 1, resulting from the large flexibility thereof obtained by decreased wall thickness. When the knurled plug terminals 2 are inserted into casing 1 and the metal rings 4 mounted under pressure on casing, or fuse tube 1, the knurls 2*d* in rings 4 dig into the relatively soft material of casing, or fuse tube 1, thus forming recesses in casing 1 which are negatives of the knurled portion of plugs 2. In FIGS. 4 and 5 the direction of the pressure exerted by rings 4 has been indicated by arrows R. It will be apparent from FIGS. 1 to 5 that the knurled portion of plug terminals 2 does not extent over their entire lateral surfaces, but is limited to a center zone 2*d* thereof. Below center zone 2*d* there is a groove zone, where the ends of fusible elements 3 engage grooves 2*c*. Center zone 2*d* is knurled, e.g. cross-knurled, but groove zone 2*e* is unknurled. FIGS. 1, 3 and 4 show three-layer casings as described in U.S. Pat. No. 3,979,709, while FIG. 5 shows a casing whose elasticity is due to the small thickness thereof.

The axially outer ends 2*e* of plugs 2 are not knurled so that the channels formed between knurls are closed at the axially outer ends thereof.

While clamping ring 4 may be made of various metals, it is preferably made of aluminum.

I claim as my invention:

1. An electric fuse including (a) a fusible element immersed in a pulverulent arc-quenching filler;

(b) a tubular fuse casing of a relatively elastic and relatively soft reinforced synthetic resin having the same cross-section along the entire length thereof housing said fusible element and said filler;

(c) a pair of circular terminal plugs having end surfaces of substantially equal area press-fitted into the ends of said casing and conductively interconnected by said fusible element, said pair of terminal plugs having knurled lateral walls; and (d) a pair of annular fasteners exposing the axially outer end surfaces of said pair of terminal plugs mounted on said casing each adjacent one of the ends thereof and pressing the wall of said casing radially inwardly into firm engagement with said knurled lateral walls of said pair of terminal plugs.

2. A fuse as specified in claim 1 wherein said casing comprises an innermost ply of a woven glass cloth, an outermost ply of woven glass cloth, at least one intermediate ply of non-woven glass mat arranged between said innermost ply and said outermost ply and wherein said plies are united by a polyester resin.

3. A fuse as specified in claim 1 wherein said pair of terminal plugs have cross-knurled lateral walls 4. A fuse as specified in claim 1 wherein each of said pair of annular fasteners is formed by a metal ring.

5. A fuse as specified in claim 1 wherein each of said pair of annular fasteners is formed by an aluminum ring.

6. A fuse as specified in claim 1 having a plurality of fusible elements wherein said pair of terminal plugs have grooves for receiving the ends of said plurality of fusible elements, and wherein the knurl of the lateral walls of said pair of plugs stops at a level defined by the bottom of said grooves.

* * * * *